US011118130B2

(12) United States Patent
Kitamura

(10) Patent No.: US 11,118,130 B2
(45) Date of Patent: Sep. 14, 2021

(54) METALWORKING OIL COMPOSITION

(71) Applicant: IDEMITSU KOSAN CO., LTD., Chiyoda-ku (JP)

(72) Inventor: Tomohiko Kitamura, Chiba (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 16/088,530

(22) PCT Filed: Mar. 31, 2017

(86) PCT No.: PCT/JP2017/013744
§ 371 (c)(1),
(2) Date: Sep. 26, 2018

(87) PCT Pub. No.: WO2017/171054
PCT Pub. Date: Oct. 5, 2017

(65) Prior Publication Data

US 2019/0106653 A1 Apr. 11, 2019

(30) Foreign Application Priority Data

Mar. 31, 2016 (JP) ..... JP2016-073062

(51) Int. Cl.

| | |
|---|---|
| ***C10M 169/04*** | (2006.01) |
| ***C10M 135/06*** | (2006.01) |
| ***C10M 141/08*** | (2006.01) |
| ***B21D 37/18*** | (2006.01) |
| ***C10M 129/92*** | (2006.01) |
| ***C10M 145/22*** | (2006.01) |
| ***C10M 161/00*** | (2006.01) |
| ***C10N 20/02*** | (2006.01) |
| ***C10N 30/02*** | (2006.01) |
| ***C10N 30/06*** | (2006.01) |
| ***C10N 40/22*** | (2006.01) |
| ***C10N 40/20*** | (2006.01) |

(52) U.S. Cl.
CPC ..... *C10M 169/044* (2013.01); *B21D 37/18* (2013.01); *C10M 129/92* (2013.01); *C10M 135/06* (2013.01); *C10M 141/08* (2013.01); *C10M 145/22* (2013.01); *C10M 161/00* (2013.01); *C10M 2203/003* (2013.01); *C10M 2207/2815* (2013.01); *C10M 2207/40* (2013.01); *C10M 2209/102* (2013.01); *C10M 2219/024* (2013.01); *C10N 2020/02* (2013.01); *C10N 2030/02* (2013.01); *C10N 2030/06* (2013.01); *C10N 2040/22* (2013.01); *C10N 2040/246* (2020.05)

(58) Field of Classification Search
CPC ..... C10M 169/044; C10M 129/92; C10M 145/22; C10M 161/00; C10M 135/06; C10M 141/08; C10M 2207/2815; C10M 2203/003; C10M 2207/40; C10M 2209/102; C10M 2219/024; B21D 37/18; C10N 2220/022; C10N 2230/02; C10N 2230/06; C10N 2240/401; C10N 2240/408; C10N 2020/02; C10N 2030/02; C10N 2030/06; C10N 2040/22; C10N 2040/246
See application file for complete search history.

(56) References Cited

U.S. PATENT DOCUMENTS

| | | | | |
|---|---|---|---|---|
| 5,723,417 | A * | 3/1998 | Kitahara | C08G 63/199 508/455 |
| 5,780,399 | A * | 7/1998 | Ishikawa | C08G 63/48 508/452 |
| 6,710,021 | B1 * | 3/2004 | Fisher | C10M 125/06 508/152 |
| 7,645,727 | B2 * | 1/2010 | Harris | C10M 135/02 508/322 |
| 9,029,306 | B2 * | 5/2015 | Takagi | C10M 173/00 508/505 |
| 9,683,189 | B2 * | 6/2017 | Takagi | C10M 173/00 |
| 2005/0245403 | A1 * | 11/2005 | Harris | C10M 141/08 508/322 |
| 2012/0184475 | A1 * | 7/2012 | Takagi | C10M 173/00 508/505 |
| 2014/0326117 | A1 * | 11/2014 | Takagi | C10M 173/00 83/22 |
| 2016/0326450 | A1 * | 11/2016 | Kitamura | C10M 169/04 |

FOREIGN PATENT DOCUMENTS

| | | |
|---|---|---|
| CN | 103525517 | 1/2014 |
| CN | 104087404 A | 10/2014 |
| JP | 4-202400 A | 7/1992 |

(Continued)

OTHER PUBLICATIONS

International Search Report dated Apr. 25, 2017 in PCT/JP2017/013744 filed Mar. 31, 2017.

(Continued)

*Primary Examiner* — Pamela H Weiss

(74) *Attorney, Agent, or Firm* — Oblon, McClelland, Maier & Neustadt, L.L.P.

(57) ABSTRACT

Disclosed is a metalworking oil composition containing:

at least one base oil (A) selected from a mineral oil and a synthetic oil;

sulfurized oils and fats (B) having a kinematic viscosity at 40° C. of 60 $mm^2/s$ or more and 1,600 $mm^2/s$ or less; and a polymer (C) of an unsaturated fatty acid having a carbon number of 10 or more.

11 Claims, No Drawings

(56) References Cited

FOREIGN PATENT DOCUMENTS

| | | | | |
|---|---|---|---|---|
| JP | 6-256789 | A | | 9/1994 |
| JP | 8-20790 | A | | 1/1996 |
| JP | 2000256695 | A | * | 9/2000 |
| JP | 2001-49279 | A | | 2/2001 |
| JP | 2002-294264 | A | | 10/2002 |
| JP | 2009-161585 | A | | 7/2009 |
| JP | 2011-111593 | | | 6/2011 |
| JP | 2013-107937 | | | 6/2013 |
| JP | 2015-189929 | | | 11/2015 |
| JP | 2016-508180 | | | 3/2016 |
| WO | WO 2015/107818 | A1 | | 7/2015 |
| WO | WO 2015/107828 | A1 | | 7/2015 |

OTHER PUBLICATIONS

Office Action dated Sep. 29, 2020, in Japanese patent application No. 2018-509687, w/English translation (10 pages).
Office Action in JP Application No. 2018-509687, dated Feb. 16, 2021, with English Translation, 9 pages.
Office Action in CN Application No. 201780020051.2, dated Apr. 30, 2021, 8 pages.

* cited by examiner

METALWORKING OIL COMPOSITION

TECHNICAL FIELD

The present invention relates to a metalworking oil composition.

BACKGROUND

In recent years, in a lot of fields inclusive of medical industry, aircraft industry, automotive industry, and energy industry, attention is riveted to a heat-resistant alloy. The heat-resistant alloy is hardly achieved for cutting or graining and is named a so-called difficult-to-machine material. In cutting machining of such a difficult-to-machine material, for example, the machining is performed with a high-rigidity machine tool mounted with a high-torque type principal axis while using a large quantity of a cooling liquid.

In such machining of a difficult-to-machine material, the cutting is performed powerfully by the high-torque type principal axis, and therefore, the tool life becomes short due to wear or the like, resulting in a serious problem of a lowering of productivity or an increase of costs based on exchange of the tool or the like.

An attempt to suppress such tool wear by a metalworking oil composition to be used at the time of machining is made. For example, PTL 1 discloses a water-insoluble cutting/grinding oil composition containing a methacrylate-based polymer, a sulfur-based extreme pressure additive, and a calcium sulfonate or zinc-based sulfonate compound. PTL 2 discloses a metalworking oil composition containing a base oil, an active sulfur-containing compound, an overbased sulfonate, and an aryl-type zinc dithiophosphate.

CITATION LIST

Patent Literature

PTL 1: JP 2001-49279 A
PTL 2: JP 8-20790 A

SUMMARY OF INVENTION

Technical Problem

However, in the case of using the aforementioned conventional machining oils, at the time of machining of a difficult-to-machine material, the tool wear has not been thoroughly suppressed yet, and the tool life becomes short. As a result, the aforementioned conventional machining oils cannot respond to the conventional problem of a lowering of productivity or an increase of costs based on exchange of the tool or the like.

A problem of the present invention is to provide a metalworking oil composition which is suitable for machining of a difficult-to-machine material and capable of thoroughly reducing the tool wear at the time of metalworking.

Solution to Problem

The present inventor and others made extensive and intensive investigations. As a result, it has been found that the aforementioned problem can be solved by a metalworking oil composition containing, a base oil, sulfurized oils and fats having a specified viscosity at 40° C., and a polymer of a specified unsaturated fatty acid, thereby leading to accomplishment of the present invention.

Specifically, the present invention provides the following [1] to [2].

[1] A metalworking oil composition containing:

at least one base oil (A) selected from a mineral oil and a synthetic oil;

sulfurized oils and fats (B) having a kinematic viscosity at 40° C. of 60 $mm^2/s$ or more and 1,600 $mm^2/s$ or less; and a polymer (C) of an unsaturated fatty acid having a carbon number of 10 or more.

[2] A metalworking method, including machining a metal by using the metalworking oil composition as set forth in the above [1].

Advantageous Effects of Invention

In accordance with the present invention, it is possible to provide a metalworking oil composition which is suitable for machining of a difficult-to-machine material and capable of significantly reducing the tool wear at the time of metalworking and a metalworking method.

DESCRIPTION OF EMBODIMENTS

Embodiments of the present invention are hereunder described in detail.

In this specification, the kinematic viscosity means a kinematic viscosity measured in conformity with JIS K2283:2000.

[Metalworking Oil Composition]

The metalworking oil composition according to the present embodiment contains a base oil (A), specified sulfurized oils and fats (B), and a polymer (C) of a specified unsaturated fatty acid. The metalworking oil composition according to the present embodiment is hereunder mentioned in detail.

<Base Oil (A)>

The base oil (A) which is contained in the metalworking oil composition according to the present embodiment is at least one selected from a mineral oil and a synthetic oil.

As the mineral oil, various materials can be used without being particularly limited. Examples thereof include distillates obtained by subjecting a paraffinic crude oil, a mixed crude oil, or a naphthenic crude oil to atmospheric distillation, or subjecting a residual oil obtained from the atmospheric distillation to distillation under reduced pressure, and refined oils obtained by subjecting these oils to ordinary purification treatments, for example, solvent-refined oils, hydrogenation refined oils, dewaxed oils, and clay-treated oils.

Examples of the synthetic oil include ester-based compounds, such as octyl palmitate, 2-ethylhexyl palmitate, octyl stearate, 2-ethylhexyl oleate, a polyol ester (for example, a triester of trimethylolpropane and a fatty acid, e.g., n-octanoic acid, and a tetraester of pentaerythritol and a fatty acid, e.g., n-octanoic acid), a dibasic acid ester, and a phosphoric acid ester; poly-α-olefins, such as polybutene, polypropylene, an α-olefin oligomer having a carbon number of 8 to 16, and hydrides thereof; alkyl aromatic compounds, such as an alkylbenzene and an alkylnaphthalene; polyglycol oils, such as a polyoxyalkylene glycol; polyphenyl ethers; and silicone oils. Above all, it is more preferred to use an ester-based compound from the viewpoints of low viscosity and high flash point.

In the present embodiment, an unsaturated fatty acid having a carbon number of 10 or more, and a polymer of the foregoing unsaturated fatty acid are not classified into the synthetic oil. In the present embodiment, the "flash point" is a value measured by the Cleveland open cup method (COC method) in conformity with JIS K2265-4:2007.

A kinematic viscosity at 40° C. of the base oil (A) is preferably 2 $mm^2/s$ or more and 40 $mm^2/s$ or less, more preferably 3 $mm^2/s$ or more and 30 $mm^2/s$ or less, and still more preferably 5 $mm^2/s$ or more and 20 $mm^2/s$ or less. What the range of the kinematic viscosity at 40° C. of the base oil (A) is 2 $mm^2/s$ or more and 40 $mm^2/s$ or less is preferred in view of working environment as well as security of safety from the standpoint of inflammability.

<Sulfurized Oils and Fats (B)>

The sulfurized oils and fats (B) which are contained in the metalworking oil composition according to the present embodiment are required to have a viscosity at 40° C. of 60 $mm^2/s$ or more and 1,600 $mm^2/s$ or less. When the aforementioned kinematic viscosity is less than 60 $mm^2/s$, the tool wear at the time of machining cannot be thoroughly suppressed. What the kinematic viscosity is more than 1,600 $mm^2/s$ is not preferred because the viscosity of the metalworking oil composition per se increases, a load of a pump for pumping up the oil at the time of machining increases, and the oil is carried away with a cut chip, resulting in an increase of the amount of consumption of the oil.

The kinematic viscosity of the sulfurized oils and fats (B) is preferably 100 $mm^2/s$ or more and 1,400 $mm^2/s$ or less, more preferably 150 $mm^2/s$ or more and 1,200 $mm^2/s$ or less, still more preferably 200 $mm^2/s$ or more and 1,000 $mm^2/s$ or less, and especially preferably 300 $mm^2/s$ or more and 1,000 $mm^2/s$ or less.

The sulfurized oils and fats (B) refer to sulfides of animal and vegetable oils, and examples thereof include sulfurized lard, sulfurized rapeseed oil, sulfurized castor oil, and sulfurized soybean oil. In addition, disulfide fatty acids, such as oleic sulfide, and sulfurized esters, such as sulfurized methyl oleate, are also included in the sulfurized oils and fats (B). As the sulfurized oils and fats, those having a sulfur content of typically 5 mass % or more and 25 mass % or less, and for the purpose of more suppressing the tool wear, preferably 8 mass % or more and 19 mass % or less on a basis of the compound are used.

The content of the sulfurized oils and fats (B) in the metalworking oil composition according to the present embodiment is preferably 1 mass % or more and 30 mass % or less, more preferably 3 mass % or more and 20 mass % or less, and still more preferably 5 mass % or more and 15 mass % or less on a basis of the total amount of the composition. When the content of the sulfurized oils and fats (B) is 1 mass % or more on a basis of the total amount of the composition, the tool wear at the time of machining can be thoroughly suppressed. In addition, when the content is 30 mass % or less, the viscosity of the composition is kept at an appropriate value, whereby the load of the pump at the time of machining can be reduced. In addition, the matter that the oil is carried away with a cut chip is suppressed, whereby the amount of consumption of the oil can be suppressed.

<Polymer (C) of Unsaturated Fatty Acid>

The polymer (C) of an unsaturated fatty acid which is contained in the metalworking oil composition according to the present embodiment is required such that the carbon number of the unsaturated fatty acid that is a monomer constituting the polymer (C) is 10 or more. What the carbon number of the unsaturated fatty acid is less than 10 is not preferred because the molecule of the polymer (C) is small, resulting in a problem, such as evaporation to be caused due to heat at the time of machining. In the polymer (C), the carbon number of the unsaturated fatty acid is preferably 10 or more and 24 or less, more preferably 16 or more and 22 or less, and still more preferably 18 or more and 20 or less.

Examples of the aforementioned polymer (C) of an unsaturated fatty acid having a carbon number of 10 or more include dehydrated condensates of an unsaturated fatty acid having a carbon number of 10 or more and 24 or less. Examples of the unsaturated fatty acid having a carbon number of 10 or more and 24 or less include naturally occurring unsaturated fatty acids, such as castor oil and tall oil fatty acids. Specifically, the foregoing unsaturated fatty acid is preferably at least one selected from the group consisting of ricinoleic acid, oleic acid, and linoleic acid. The aforementioned dehydrated condensate of an unsaturated fatty acid may be a polymer resulting from dehydration condensation of an unsaturated fatty acid alone, or it may also be a copolymer resulting from polymerization of unsaturated fatty acid of plural species. For example, the dehydrated condensate of an unsaturated fatty acid may be a dehydrated condensate (copolymer) resulting from dehydration condensation of one or more of the aforementioned unsaturated fatty acids having a carbon number of 10 or more and 24 or less. Above all, it is preferred to use a dehydrated condensate of ricinoleic acid.

A kinematic viscosity at 40° C. of the polymer (C) of an unsaturated fatty acid according to the present embodiment is preferably 100 $mm^2/s$ or more and 1,400 $mm^2/s$ or less, more preferably 200 $mm^2/s$ or more and 1,000 $mm^2/s$ or less, and still more preferably 300 $mm^2/s$ or more and 900 $mm^2/s$ or less. What the kinematic viscosity at 40° C. of the polymer (C) of an unsaturated fatty acid falls within the aforementioned range is preferred from the viewpoints of suppression of the tool wear, viscosity of the composition, amount of consumption of the oil, and the like.

It is also preferred that the polymer (C) of an unsaturated fatty acid in the present embodiment has the following properties (i.e., acid value, hydroxyl value, and saponification value).

The polymer (C) of an unsaturated fatty acid has an acid value of preferably 30 to 80 mgKOH/g, more preferably 40 to 70 mgKOH/g, and still more preferably 50 to 60 mgKOH/g. Here, the acid value can be used as an index of "degree of polymerization" of the unsaturated fatty acid. When the acid value of the polymer (C) of an unsaturated fatty acid falls within the aforementioned range, a disadvantage that the oil is carried away with a cut chip, resulting in an increase of the amount of consumption of the oil can be suppressed.

The polymer (C) of an unsaturated fatty acid has a saponification value of preferably 100 to 300 mgKOH/g, more preferably 150 to 250 mgKOH/g, and still more preferably 190 to 200 mgKOH/g. When the saponification value of the polymer (C) of an unsaturated fatty acid falls within the aforementioned range, an excellent machining performance can be attained.

The polymer (C) of an unsaturated fatty acid has a hydroxyl value of preferably 5 to 100 mgKOH/g, more preferably 10 to 50 mgKOH/g, and still more preferably 15 to 30 mgKOH/g. When the hydroxyl value of the polymer (C) of an unsaturated fatty acid falls within the aforementioned range, an excellent machining performance can be attained.

Here, the acid value is a value measured on a basis of JIS K2501:2203 (indicator method), the saponification value is a value measured on a basis of JIS K2503:2010, and the hydroxyl value is a value measured on a basis of JIS K0070:1992.

The metalworking oil composition according to the present embodiment contains the aforementioned polymer (C) of an unsaturated fatty acid in an amount of preferably 0.2 mass % or more and 20 mass % or less, and more preferably 0.5 mass % or more and 20 mass % or less on a basis of the total amount of the composition. When the content of the polymer (C) of an unsaturated fatty acid is 0.2 mass % or more, the tool wear at the time of machining can be thoroughly suppressed. In addition, when the content is 20 mass % or less, the viscosity of the composition is kept at an appropriate value, whereby the load of the pump at the time of machining can be reduced. In addition, the matter that the oil is carried away with a cut chip is suppressed, whereby the amount of consumption of the oil can be suppressed.

The content of the aforementioned polymer of an unsaturated fatty acid is still more preferably 1 mass % or more and 15 mass % or less, and especially preferably 2 mass % or more and 10 mass % or less on a basis of the total amount of the composition.

A mass ratio of the sulfurized oils and fats (B) and the polymer (C) of an unsaturated fatty acid having a carbon number of 10 or more [(B)/(C)], both of which are contained in the metalworking oil composition according to the present embodiment, is preferably 0.1 or more and 30 or less. By allowing the mass ratio [(B)/(C)] to fall within the aforementioned range, the tool wear can be effectively suppressed.

The aforementioned mass ratio [(B)/(C)] is more preferably 0.1 or more and less than 30, still more preferably 0.2 or more and 20 or less, and especially preferably 0.5 or more and 10 or less.

The metalworking oil composition according to the present embodiment may further contain an unsaturated fatty acid as the fatty acid compound, in addition to the polymer (C) of an unsaturated fatty acid. Examples of the unsaturated fatty acid include various unsaturated fatty acids prior to the aforementioned dehydration condensation. In the case of containing the unsaturated fatty acid in addition to the component (C), its content is preferably 0.1 mass % or more and 10 mass % or less, and more preferably 0.2 mass % or more and 8 mass % or less on a basis of the total amount of the composition.

<Other Component>

The metalworking oil composition according to the present invention may contain an additive other than the aforementioned components (A) to (C) and unsaturated fatty acid within a range where the effects of the present invention are not impaired, as the need arises. Examples thereof include known additives, such as an oily agent, an extreme pressure agent, an anti-wear agent, an antioxidant, a metal deactivator, an anti-foaming agent, a mist suppressant, a rust inhibitor, and a dispersant. Compounds shown as specific examples of each of the additives as mentioned later may be used alone, or may be used in combination of two or more thereof.

<Oily Agent, Extreme Pressure Agent, and Anti-Wear Agent>

Examples of the oily agent include dibasic acids represented by maleic acid, an alkyl or alkenyl maleic acid, oxalic acid, succinic acid, and an alkyl or alkenyl succinic acid, and esters thereof; tribasic acids and esters thereof fatty acids, such as rapeseed oil and soybean aperture white oil; fatty acids esters; and oils and fats.

Examples of the extreme pressure agent include elemental sulfur in a block-like, powder-like, or molten liquid-like state; a polysulfide; chlorine-based extreme pressure agents, such as a chlorinated paraffin, chlorinated oils and fats, a chlorinated fatty acid ester, and a chlorinated fatty acid; and phosphorus-based extreme pressure agents, such as a phosphoric acid ester, a thiophosphoric acid ester, a dithiophosphoric acid ester, a phosphoric acid ester amine salt, a thiophosphoric acid ester amine salt, a dithiophosphoric acid ester amine salt, a phosphorous acid ester, a thiophosphorous acid ester, and a dithiophosphorous acid ester.

Examples of the anti-wear agent include zinc dithiophosphate (ZnDTP), zinc dithiocarbamate (ZnDTC), molybdenum oxysulfide dithiophosphate (MoDTP), and molybdenum oxysulfide dithiocarbamate (MoDTC).

<Antioxidant and Metal Deactivator>

Examples of the antioxidant include amine-based antioxidants, such as diphenylamine, an alkyl diphenylamine, phenyl-α-naphthylamine, and an alkylphenyl-α-naphthylamine; phenol-based antioxidants, such as 4,4'-methylene-bis-2,6-di-t-butylphenol and 2,6-di-t-butyl-p-cresol (DBPC); sulfur-based antioxidants; and molybdenum amine complex-based antioxidants.

Examples of the metal deactivator include benzotriazole, a triazole derivative, a benzotriazole derivative, and a thiadiazole derivative.

<Anti-Foaming Agent, Mist Suppressant, Rust Inhibitor, and Dispersant>

Examples of the anti-foaming agent include a dimethylpolysiloxane and a fluoroether.

As the mist suppressant, hydrocarbon-based polymer compounds, such as polyisobutylene and an ethylene-propylene copolymer, can be used. A number average molecular weight of the aforementioned polymer compound is preferably 100,000 to 3,000,000, and more preferably 200,000 to 2,000,000.

Examples of the rust inhibitor include fatty acid esters of a polyhydric alcohol, such as a sorbitan fatty acid ester, and metal sulfonates (for example, calcium sulfonate).

Examples of the dispersant include ash-free dispersants, such as an alkyl or alkenyl succinimide, an alkyl or alkenyl succinic acid ester, and an acid amide.

Although the content of the other additive is not particularly limited, it is in a range of typically from 0.01 to 10 mass %, and preferably from 0.1 to 5 mass % on a basis of the total amount of the composition. In the case where a plurality of other additives are contained, each of the additives may be independently contained in the aforementioned range.

Although the metalworking oil composition according to the present embodiment may contain, in addition to the aforementioned components (A) to (C), the unsaturated fatty acid and other additive, it should be construed that a total content thereof does not exceed 100 mass %.

In one embodiment of the present invention, a total content of the components (A), (B), and (C) is preferably 80 to 100 mass %, and more preferably 95 to 100 mass % on a basis of the total amount (100 mass %) of the metalworking oil composition.

In one embodiment of the present invention, a total content of the components (A), (B), and (C), the unsaturated fatty acid, and the aforementioned other additive is preferably 90 to 100 mass %, and more preferably 95 to 100 mass % on a basis of the total amount (100 mass %) of the metalworking oil composition.

A kinematic viscosity at 40° C. of the metalworking oil composition according to the present embodiment is preferably 3 $mm^2/s$ or more and 60 $mm^2/s$ or less. When the kinematic viscosity of the metalworking oil composition is 3 $mm^2/s$ or more, the generation of mist or soot can be suppressed. In addition, when the kinematic viscosity is 60

$mm^2/s$ or less, a load of the pump at the time of machining can be reduced. In addition, the matter that the oil is carried away with a cut chip is suppressed, whereby the amount of consumption of the oil can be suppressed.

The kinematic viscosity at 40° C. of the aforementioned metalworking oil composition is more preferably 4 $mm^2/s$ or more and 50 $mm^2/s$ or less, still more preferably 5 $mm^2/s$ or more and 40 $mm^2/s$ or less, and especially preferably 8 $mm^2/s$ or more and 30 $mm^2/s$ or less.

The metalworking oil composition according to the present embodiment can be, for example, suitably used for cutting and/or grinding machining of a metal, and preferably, it is used as a cutting machining oil to be used for cutting machining of a metal. As a workpiece, at least one metal selected from a nickel-base alloy, a titanium alloy, and an iron-based material, which is a so-called difficult-to-machine material, can be exemplified. Examples of the nickel-base alloy include Hastelloy (registered trademark), Inconel (registered trademark), Tomilloy (registered trademark), and Waspaloy (a trade name of United Technologies Corporation).

Next, the metalworking method according to the present embodiment is described.

<Metalworking Method>

As for the kind of the metalworking, the metalworking method can be suitably utilized in various metalworking fields inclusive of cutting machining, grinding machining, punching machining, polishing machining, deep drawing machining, drawing machining, and rolling machining. Among those, cutting machining or grinding machining is preferred. Examples of the grinding machining include grinding, honing finishing, super finishing, lapping finishing (dry-wet), barrel finishing, and liquid honing. Examples of the cutting machining include turning, milling, boring, drilling machining (e.g., drilling, tapping, and reaming), gear cutting, planning, shaping, slotting, broaching, and gear shaping. Above all, the metalworking method can be suitably adopted for cutting machining. As the workpiece, at least one metal selected from a nickel-base alloy, a titanium alloy, and an iron-based material can be exemplified, as mentioned above.

The present embodiment also provides use of the aforementioned metalworking oil composition at the time of metalworking. The aforementioned metalworking oil composition can be suitably used for all of wet machining and near-dry machining. For example, a supplying method of the aforementioned metalworking oil composition may be a circulation supplying type in which a large quantity of the metalworking oil composition is supplied to a machining point, or it may also be so-called MQL (minimum quantity lubrication), in which a mist of a carrier gas and a metalworking oil composition is supplied to a machining point.

EXAMPLES

The present embodiments are hereunder more specifically described by reference to Examples, but it should be construed that the present embodiments are by no means limited thereto.

Examples 1 to 8 and Comparative Examples 1 to 6

Metalworking oil compositions were each prepared by using components in proportions as shown in Table 1.

Properties and tool wear properties of each of the metalworking oil compositions were evaluated by the following evaluation methods. The results are also shown in Table 1.

[Each of Evaluation Methods]

(1) Kinematic Viscosity

The kinematic viscosity at 40° C. was measured in conformity with JIS K2283:2000.

(2) Tool Wear Properties

Using an NC lathe, QUICKTURN-15N (manufactured by Yamazaki Mazak Corporation) as a working machine, CNMA 120404 VP15TF (manufactured by Mitsubishi Materials Corporation) as a tool, DCLNL 2020K12 (manufactured by Mitsubishi Materials Corporation) as a holder, and Inconel (registered trademark) as a workpiece, cutting was performed under the following cutting condition, and a maximum wear width (μm) of the tool flank was then measured.

<Test Condition>

Cutting rate: 30 m/min, feed rate: 0.1 mm/rev, cut-out: 0.25 mm, machining distance: 533 m

TABLE 1

| | | | Example | | | | | | | |
|---|---|---|---|---|---|---|---|---|---|---|
| Component | | Unit | 1 | 2 | 3 | 4 | 5 | 6 | 7 | 8 |
| (A) | Mineral oil (a1) | wt % | 91.0 | — | 45.5 | 87.0 | 82.0 | 88.0 | 91.0 | 93.8 |
| | Synthetic oil (a2) | wt % | — | 91.0 | 45.5 | — | — | — | — | — |
| (B) | Sulfurized oils and fats (b1) | wt % | 6.0 | 6.0 | 6.0 | 10.0 | 15.0 | 6.0 | — | 6.0 |
| | Sulfurized oils and fats (b2) | wt % | — | — | — | — | — | — | 6.0 | — |
| Other sulfurized oils and fats | | wt % | — | — | — | — | — | — | — | — |
| (C) | Polymer of unsaturated fatty acid | wt % | 3.0 | 3.0 | 3.0 | 3.0 | 3.0 | 6.0 | 3.0 | 0.2 |
| Others | ZnDTP | wt % | — | — | — | — | — | — | — | — |
| | Polysulfide | wt % | — | — | — | — | — | — | — | — |
| | Ca sulfonate | wt % | — | — | — | — | — | — | — | — |
| Total | | wt % | 100 | 100 | 100 | 100 | 100 | 100 | 100 | 100 |
| Ratio | (B)/(C) | | 2.00 | 2.00 | 2.00 | 3.33 | 5.00 | 1.00 | 2.00 | 30.00 |
| Kinematic viscosity at 40° C. | | $mm^2/s$ | 12.1 | 11.9 | 12.0 | 13.9 | 16.0 | 13.5 | 14.5 | 11.1 |
| Maximum wear width of tool flank | | μm | 163.9 | 162.1 | 162.5 | 157.6 | 154.2 | 155.2 | 165.1 | 171.0 |

TABLE 1-continued

| Component | | Unit | Comparative Example 1 | 2 | 3 | 4 | 5 | 6 |
|---|---|---|---|---|---|---|---|---|
| (A) | Mineral oil (a1) | wt % | 94.0 | 97.0 | 89.5 | 88.0 | 89.0 | 93.0 |
| | Synthetic oil (a2) | wt % | — | — | — | — | — | — |
| (B) | Sulfurized oils and fats (b1) | wt % | 6.0 | — | 0.5 | — | — | 6.0 |
| | Sulfurized oils and fats (b2) | wt % | — | — | — | — | 4.0 | — |
| Other sulfurized oils and fats | | wt % | — | — | — | 9.0 | — | — |
| (C) | Polymer of unsaturated fatty acid | wt % | — | 3.0 | 10.0 | 3.0 | — | — |
| Others | ZnDTP | wt % | — | — | — | — | 1.0 | 1.0 |
| | Polysulfide | wt % | — | — | — | — | 5.0 | — |
| | Ca sulfonate | wt % | — | — | — | — | 1.0 | — |
| Total | | wt % | 100 | 100 | 100 | 100 | 100 | 100 |
| Ratio | (B)/(C) | | — | — | 0.05 | 3.00 | — | — |
| Kinematic viscosity at 40° C. | | $mm^2/s$ | 11.0 | 9.3 | 11.2 | 10.6 | 12.3 | 11.2 |
| Maximum wear width of tool flank | | μm | 171.2 | 175.3 | 172.0 | 174.1 | 180.1 | 171.5 |

<Blending Materials>

<Component (A)>

Mineral oil (a1): Kinematic viscosity at 40° C.: 8.39 $mm^2/s$, flash point: 164° C.

Synthetic oil (a2): Kinematic viscosity at 40° C.: 8.03 $mm^2/s$, 2-ethylhexyl palmitate <Component (B)>

Sulfurized oils and fats (b1): Kinematic viscosity at 40° C.: 381.7 $mm^2/s$, S component: 10.4 wt %

Sulfurized oils and fats (b2): Kinematic viscosity at 40° C.: 900.0 $mm^2/s$, S component: 11.6 wt %

<Other Sulfurized Oils and Fats>

Kinematic viscosity at 40° C.: 55.0 $mm^2/s$, S component: 17.5 wt %

<Component (C)>

Polymer of unsaturated fatty acid: A polymer of an unsaturated fatty acid obtained by subjecting ricinoleic acid (carbon number: 18) to heat dehydration condensation at 200° C. in a nitrogen gas stream. Acid value: 52 mgKOH/g, saponification value: 196 mgKOH/g, hydroxyl value: 20 mgKOH/g, kinematic viscosity at 40° C.: 380 $mm^2/s$ <Others>

ZnDTP: S component: 5.8 wt %, P component: 2.9 wt %, Zn component: 3.0 wt %

Polysulfide: Kinematic viscosity at 40° C.: 45 $mm^2/s$, S component: 38.0 wt %

Ca sulfonate: Base number: 320 mg/KOH, Ca component: 12.5 wt %

From the foregoing results, it is noted that on the occasion of performing cutting machining of a difficult-to-machine material under the same condition, in the metalworking oil compositions of the Examples, the maximum wear width of the tool flank is small, and the tool wear is significantly suppressed, as compared with the metalworking oil compositions of the Comparative Examples. In all of Comparative Example 1 not containing the component (C), Comparative Example 2 not containing the component (B), Comparative Example 3 in which the amount of the component (B) is small, Comparative Example 4 in which the viscosity of the component (B) falls outside the scope of the present embodiment, Comparative Example 5 not containing the component (C) and containing other additives, such as ZnDTP, etc., and Comparative Example 6 not containing the component (C) and containing ZnDTP, the maximum wear width of the tool flank is large, and the tool wear is not suppressed.

INDUSTRIAL APPLICABILITY

In accordance with the present invention, it is possible to provide a metalworking oil composition which is suitable for machining of a difficult-to-machine material and capable of significantly reducing the tool wear at the time of metalworking and a metalworking method.

The invention claimed is:

1. A metal working oil composition, comprising at least one base oil (A), sulfurized oils and fats (B), and a polymer (C) and further optionally comprising one or more components selected form the group consisting of: an unsaturated fatty acid, an oily agent, an extreme pressure agent, a mist suppressant, a rust inhibitor, and a dispersant, wherein the at least one base oil (A) is selected from the group consisting of a mineral oil and a synthetic oil, and a content of the one base oil (A) is at least 82.0 wt. %, based on the total amount of the composition;

the sulfurized oils and fats (B) has a kinematic viscosity at 40° C. of from 60 $mm^2/s$ to 1,600 $mm^2/s$, and a content of the sulfurized oils and fats (B) is from 1 mass % to 30 mass %, based on the total amount of the composition; and the polymer (C) is at least one dehydrated condensate of a ricinoleic acid, the polymer (C) has a hydroxyl value of from 5 to 100 mgKOH/g, a content of the polymer (C) is from 0.2 mass % to 15 mass % based on the total amount of the composition, and a saponification value of the polymer (C) is from 100 to 300 mgKOH/g.

2. The metalworking oil composition according to claim 1, wherein a mass ratio of the sulfurized oils and fats (B) and the polymer (C), [(B)/(C)], is from 0.1 to 30.

3. The metalworking oil composition according to claim 1, wherein a kinematic viscosity at 40° C. of the polymer (C) is from 100 $mm^2/s$ to 1,400 $mm^2/s$.

4. The metalworking oil composition according to claim 1, wherein a kinematic viscosity at 40° C. of the metalworking oil composition is from 3 $mm^2/s$ to 60 $mm^2/s$.

5. A metalworking method, the method comprising machining a metal in contact with the metalworking oil composition according to claim 1.

6. The metalworking method according to claim 5, wherein the machining is cutting machining.

7. The metalworking method according to claim 5, wherein the metal is at least one selected from the group consisting of a nickel-base alloy, a titanium alloy, and an iron-based material.

8. The metalworking oil composition of claim 1, wherein a hydroxyl value of the polymer (C) is from 15 to 100 mgKOH/g.

9. The metalworking oil composition of claim 1, wherein a content of the sulfurized oils and fats (B) is from 3 mass % to 20 mass % based on the total amount of the composition.

10. The metalworking oil composition of claim 1, wherein the saponification value of the polymer (C) is from 150 to 250 mgKOH/g.

11. The metalworking oil composition according to claim 1, wherein a content of the sulfurized oils and fats (B) and the polymer (C), (B)+(C), is 18 mass % or less based on the total amount of the composition.

* * * * *